US011162278B2

(12) United States Patent
Holda

(10) Patent No.: US 11,162,278 B2
(45) Date of Patent: Nov. 2, 2021

(54) KEY FOR CONTROLLING A LOCK WITH A CYLINDRICAL PLUG AND A LOCK FOR VALIDATING THIS KEY

(71) Applicant: UrbanAlps AG, Zürich (CH)

(72) Inventor: Jiří Holda, Jaroměř (CZ)

(73) Assignee: URBANALPS AG

( * ) Notice: Subject to any disclaimer, the term of this patent is extended or adjusted under 35 U.S.C. 154(b) by 338 days.

(21) Appl. No.: 16/328,321

(22) PCT Filed: Aug. 21, 2017

(86) PCT No.: PCT/CZ2017/000053
§ 371 (c)(1),
(2) Date: Feb. 26, 2019

(87) PCT Pub. No.: WO2018/041277
PCT Pub. Date: Mar. 8, 2018

(65) Prior Publication Data

US 2020/0224454 A1 Jul. 16, 2020

(30) Foreign Application Priority Data

Sep. 1, 2016 (CZ) ..... CZ2016-529
Oct. 18, 2016 (CZ) ..... CZ2016-32953 U

(51) Int. Cl.
*E05B 29/00* (2006.01)
*E05B 19/00* (2006.01)

(52) U.S. Cl.
CPC ..... *E05B 29/0013* (2013.01); *E05B 19/0047* (2013.01); *E05B 19/0076* (2013.01); *E05B 29/0066* (2013.01)

(58) Field of Classification Search
CPC ..... E05B 29/0013; E05B 19/0047; E05B 19/0076; E05B 29/0066; E05B 19/007;
(Continued)

(56) References Cited

U.S. PATENT DOCUMENTS 213,515 A * 3/1879 Marshall
494,340 A 3/1893 Meinke
(Continued)

FOREIGN PATENT DOCUMENTS

CN 1402808 A 3/2003
CN 2637652 Y 9/2004
(Continued)

OTHER PUBLICATIONS

Chinese Office Action, dated Aug. 4, 2020, issued in corresponding Chinese Patent Application No. 201780052973.1. English translation. Total 14 pages.
(Continued)

*Primary Examiner* — Lloyd A Gall
(74) *Attorney, Agent, or Firm* — Ostrolenk Faber LLP

(57) ABSTRACT

A key that controls a lock with a cylindrical plug, the key having a shank the body of which has an external, rounded surface and forms a hollow, partially enclosed profile. The external rounded surface is shaped for turning the key in the lock cavity of the lock, while at least in the end part of the lateral section of the shank, an open cavity is created for inserting an arm of the validating lever of the lock. At least a part of the shank is U-shaped or V-shaped fitted with at least one open coding track and/or at least one coding channel with a shaped coding surface.

19 Claims, 13 Drawing Sheets

(58) Field of Classification Search
CPC ..... E05B 29/0033; E05B 27/0082; E05B 19/0041
USPC ..... 70/409, 365, 366, 495, 496, 358, 403, 70/404, 407
See application file for complete search history.

(56) References Cited

U.S. PATENT DOCUMENTS

| | | | | |
|---|---|---|---|---|
| 587,603 | A | 8/1897 | Piccioni | |
| 722,406 | A * | 3/1903 | Heidman | |
| 838,360 | A * | 12/1906 | Schroeder | |
| 838,910 | A * | 12/1906 | Schroeder | |
| 1,589,256 | A * | 6/1926 | Spruth | E05B 29/0013 70/366 |
| 1,610,497 | A * | 12/1926 | Douglas | E05B 29/0013 70/407 |
| 2,182,588 | A * | 12/1939 | Jacobi | E05B 29/0013 70/366 |
| 2,620,649 | A * | 12/1952 | Bernardo | E05B 27/00 70/358 |
| 2,648,972 | A | 8/1953 | Diesel | |
| 2,808,717 | A | 10/1957 | Jacobi | |
| 3,585,826 | A * | 6/1971 | Mercurio | E05B 29/0013 70/366 |
| 3,754,422 | A | 8/1973 | Stackhouse | 70/364 R |
| 4,044,578 | A * | 8/1977 | Guiraud | E05B 29/0013 70/366 |
| 4,083,212 | A | 4/1978 | Proefrock | |
| 4,485,648 | A * | 12/1984 | Rabinow | E05B 29/00 70/419 |
| 5,067,335 | A | 11/1991 | Widén | 70/495 |
| 5,540,071 | A * | 7/1996 | Reikher | E05B 29/00 70/492 |
| 6,553,801 | B2 * | 4/2003 | Chen | E05B 21/066 70/365 |
| 6,758,074 | B1 * | 7/2004 | Prunbauer | E05B 19/0017 70/366 |
| 7,174,757 | B1 * | 2/2007 | Tseng | E05B 15/08 70/358 |
| 7,353,675 | B1 | 4/2008 | Chao et al. | 70/358 |
| 7,621,163 | B2 | 11/2009 | Widen | |
| 7,665,336 | B2 | 2/2010 | Widén | 70/409 |
| 8,061,168 | B2 | 11/2011 | Widén | 70/409 |
| 8,099,988 | B1 | 1/2012 | Wheatland | 70/383 |
| 9,435,138 | B2 * | 9/2016 | Walls | E05B 27/0017 |
| 9,447,606 | B2 | 9/2016 | Winkler | |
| 9,624,691 | B2 | 4/2017 | Ujens | |
| 9,920,548 | B2 | 3/2018 | Ojeda González-Posada et al. | |
| 2008/0066508 | A1 | 3/2008 | Chao et al. | 70/358 |
| 2016/0290007 | A1 * | 10/2016 | Ojeda Gonzalez-Posada | E05B 19/0023 |

FOREIGN PATENT DOCUMENTS

| | | | |
|---|---|---|---|
| CN | 1620542 | A | 5/2005 |
| CN | 102713116 | A | 10/2012 |
| CN | 103210163 | A | 7/2013 |
| CN | 103470100 | A | 12/2013 |
| DE | 395252 | C | 5/1924 |
| DE | 60221165 | T2 | 3/2008 |
| JP | 2003-193715 | A | 7/2003 |
| WO | WO 89/06733 | | 7/1989 |
| WO | WO 01/34927 | A1 | 5/2001 |
| WO | WO 2006/098675 | A1 | 9/2006 |
| WO | WO 2013/121114 | A1 | 8/2013 |
| WO | WO 2015/051475 | A1 | 4/2015 |

OTHER PUBLICATIONS

Search Report dated Dec. 7, 2016 issued in corresponding Czech Patent Application No. PV 2016-529.

Chinese Notification of Grant of Patent for Invention, dated Jan. 4, 2021, issued in corresponding Chinese Patent Application No. 201780052973.1. Total 7 pages.

International Search Report dated Dec. 5, 2017 in corresponding PCT International Application No. PCT/CZ2017/000053.

Written Opinion dated Dec. 5, 2017 in corresponding PCT International Application No. PCT/CZ2017/000053.

* cited by examiner

KEY FOR CONTROLLING A LOCK WITH A CYLINDRICAL PLUG AND A LOCK FOR VALIDATING THIS KEY

CROSS-REFERENCE TO RELATED APPLICATIONS

The present application is a 35 U.S.C. §§ 371 national phase conversion of PCT/CZ2017/000053, filed Aug. 21, 2017, which claims priority to Czech Republic Patent Application Nos. PV 2016-529 and PUV 2016-32953, filed Sep. 1, 2016 and Oct. 18, 2016, respectively, the contents of which are incorporated herein by reference. The PCT International Application was published in the English language.

TECHNICAL FIELD

The invention relates to a key for controlling a lock with a cylindrical plug and furthermore to a lock for validating this key.

PRIOR ART

The closest document of the prior art for the subject of the submitted invention is the published international patent application WO 2015/051475 A1 that describes the arrangement of the key for controlling the lock with a cylindrical plug and, furthermore, the lock for validating this key. The key shank consists of a hollow enclosed body where in the internal surface of the shank cavity is a shaped coding track, possibly a coding channel. The lock for validating the key includes a blocking arm with a reference to the coding track or channel. The key shank consisting of a hollow enclosed body with coding elements is also described in patent documents U.S. Pat. Nos. 587,603 and 494,340. The disadvantage of these arrangements is the limited number of lock combinations on the order of up to several tens of thousands.

PRINCIPLE OF THE INVENTION

The task of the submitted invention is to especially increase the level of security, distribution, and the combination capability of keys for locks with a cylindrical plug so that code reading is prevented or made maximally difficult.

The subject of this invention is a key for controlling a cylindrical plug and, furthermore, a lock assembly with at least one cylindrical plug, rotatable in its housing, where in the plug body in its outer longitudinal groove is situated a sprung sidebar, which is pushed to the inner surface of the housing.

The principle of the invention consists in the key shank body being in at least a part of its length formed by a hollow partially enclosed profile, the outer round surface of which is shaped so that the key shank is rotatable in the lock cavity, while at least in the end part of the lateral section of the shank an open cavity is created for inserting an arm of the validating lever of the lock.

At least a part of the shank may be created in the U- or V-shape, while in at least one such part of the shank, the bottom and/or the wall of the inner and outer arch of the shank is fitted with at least one open coding track and/or at least one coding channel with a shaped coding surface.

The shape and/or the dimensions and/or the position of the open shaped coding track and/or coding channel change in the direction of key insertion in the longitudinal axis of its shank.

In the partially enclosed key shank profile, there may be at least two coding channels that have tracks mutually separated or intersecting.

On the outer surfaces of the key shank, additional coding elements in the shape of dimples or holes and/or grooves may also be shaped.

The subject of this invention is also a lock for verifying the authorisation of the aforementioned key, where the lock contains at least one cylindrical plug with a cavity for inserting a hollow, partially enclosed profile of the key shank, where the shank body is at least in a part of its length formed by a hollow, partially enclosed profile, the outer round surface of which is shaped for turning the key in the lock's cavity. At least in the end part of the lateral key section, an open cavity is created for inserting the lock validating lever's arm. The cylindrical plug is rotatable in its housing while in the plug body, a sprung sidebar of the lock is situated in the outer longitudinal groove, pushed to the inner surface of the housing. The sidebar is adapted for inserting into the turning validating levers that are arranged in a row in the longitudinal axis of the plug on the pivot in the plug and they are located in the lateral slots along the plug's length. These validating levers are in the blocked functional state in case of incorrect coding of the key, preventing the insertion of the sidebar into the groove in the plug, thus turning the plug inside the lock housing, while in the unblocked state in case of correct key coding, they are in the functional position allowing for the movement of the sidebar in the direction into the groove in the plug and thus turning the plug inside the lock housing, while the validating levers at least protrude into the key's cavity, which allows for achieving contact between the validating levers and the code carriers, which are e.g. the coding tracks or channels in the key.

Every validating lever may be formed by a two-arm lever where the shaped blocking end of this lever is adapted for inserting the sidebar, while the shaped end of the other arm of this lever, possibly its stump, is shaped for contact with the code carriers in the key.

The first, blocking, arm of the two-arm lever of the turning validating lever may be fitted with a protrusion for putting on a pushing spring situated inside the plug. The end of the other, coding arm of the two-arm lever of the validating lever may be shaped into a stump or a bill for contact with the open coding track or coding channel in a part of the inner wall of the partially enclosed key shank.

The blocking system contains the bar that is movable in the unblocked state between the bottom of the groove created in the lock housing and the slot in the blocking arm of the validating lever.

The lock may contains at least a blocking pin adapted for ejecting into contact with the coding dimple of the key using a spring that is possible to insert into the sidebar, while the blocking pin is in case of incorrect key coding in the blocked functional state in a position preventing complete insertion of the sidebar into the groove in the plug and thus the turning of the plug inside the lock housing, while in the unblocked state in case of correct key coding, it is in the functional position allowing for moving the sidebar into a position in which the sidebar nose is inside the contour of the lock plug, and thus the turning of the plug inside the lock housing.

An advantage of the presented invention is especially such coding that is located in the inner cavity of the key shank and that prevents scanning the key using known means (a 2D or 3D scanner) and significantly limits the possibility of visual code reading. An advantage of the described invention is also the high resistance of the key against bending and twisting, given by the shape of the hollow beam with a round surface, and the high number of combinations of the lock, with which the key cooperates.

DESCRIPTION OF THE DRAWINGS

Examples of the lock assembly and the key for its control can be seen in the attached drawings.

EXAMPLES OF IMPLEMENTATION OF THE INVENTION

Figure 1:
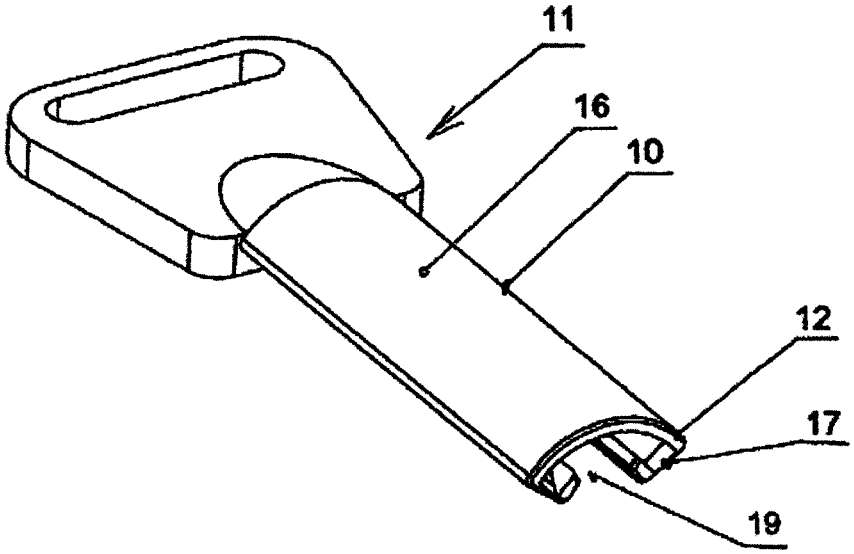
In FIG. 1 in the axonometric view, a key for lock control according to this invention is shown.

In the following description, the lock assembly and the key for its control are described. The lock contains one or two cylindrical plugs 1, where each of them is placed in its housing 2. In the plug body 1, a sprung sidebar 3 (see FIGS. 3, 4, 5, 15, 16, 17, and 18) is situated in the outer longitudinal groove, pushed by two springs 22 (placed in the cylindrical openings in the plug 1 of the lock) with its front pause 24 (nose-shaped) to the inner surface of housing 2 into the blocking position. The sidebar 3 is fitted with recesses for coil springs 22, which are seated into the bottom of the longitudinal groove 23 for the sidebar 3 into a radically externally ejected position.

Figure 16:
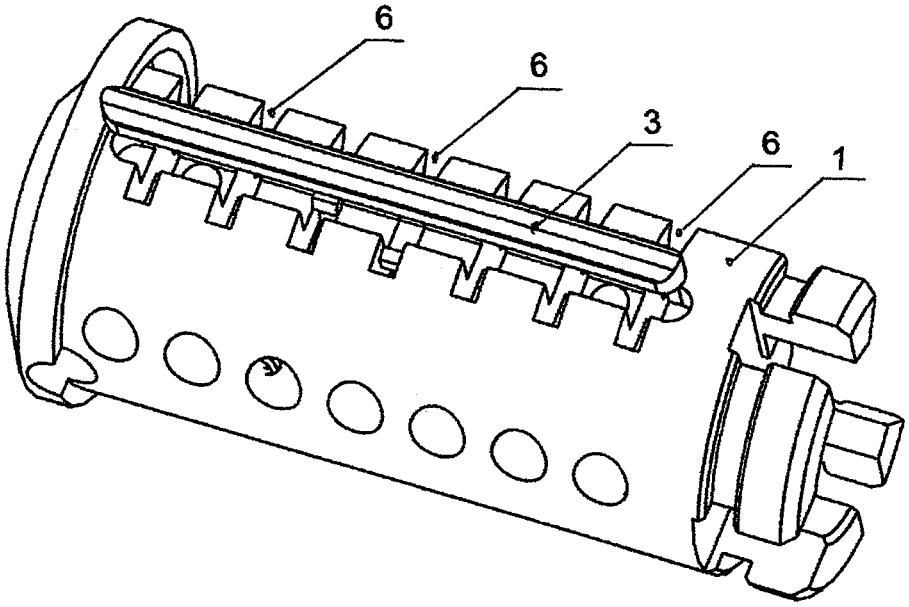
In FIG. 16 there is the axonometric view of the lock plug with the sidebar and the slots for the coding segments.
Figure 17:
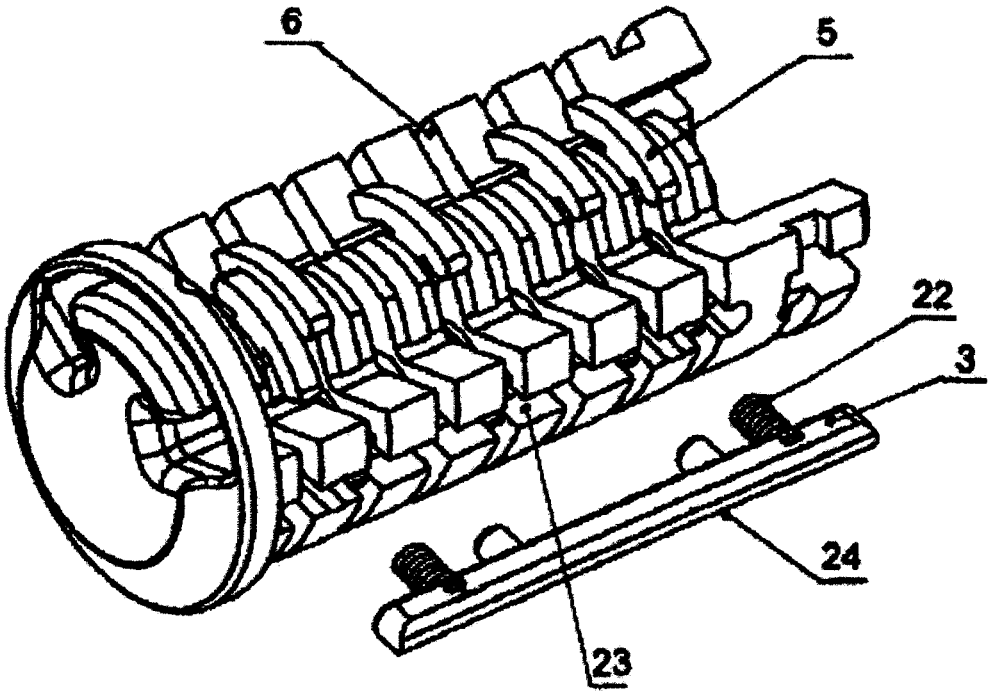
in FIG. 17 there is a view of the lock plug according to FIG. 16 with a preloaded sidebar placed on the coil springs.
Figure 18:
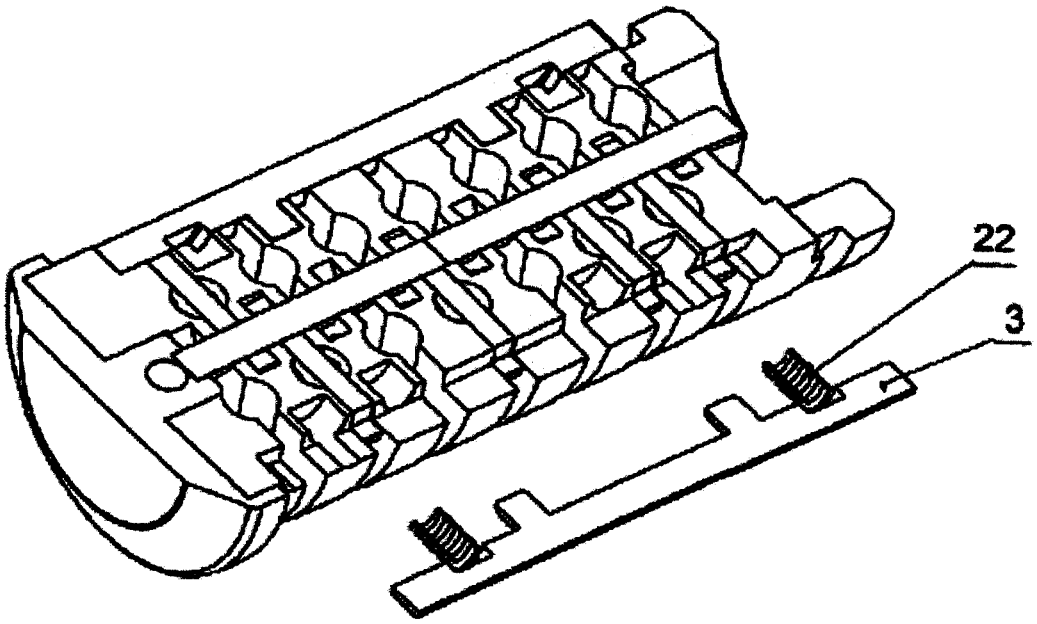
FIG. 18 shows the design according to FIG. 17 in the longitudinal section.

With the sidebar 3, the turning blocking levers 5 cooperate, arranged in a row next to each other on a common pivot in the plug 1 and they are situated in lateral slots 6 along the length of the body of the plug 1 (FIGS. 16, 17, and 18).

Figure 3:
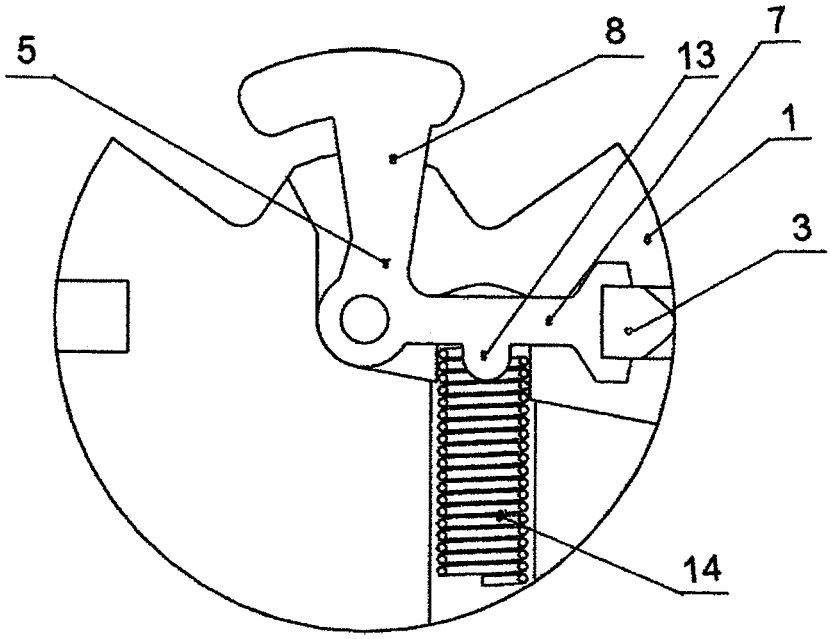
FIG. 3 shows the cylindrical plug of the lock with one of the turning blocking levers in the face view in a partial perpendicular section, where one arm of its two-arm lever is pushed by a spring into mesh with the coding surface in the key wall and its other arm is in the functional position where it fits with its recess into the sidebar that does not exceed the outer perimeter of the cylindrical plug, which allows for free turning of the plug in the plug housing body.
Figure 4:
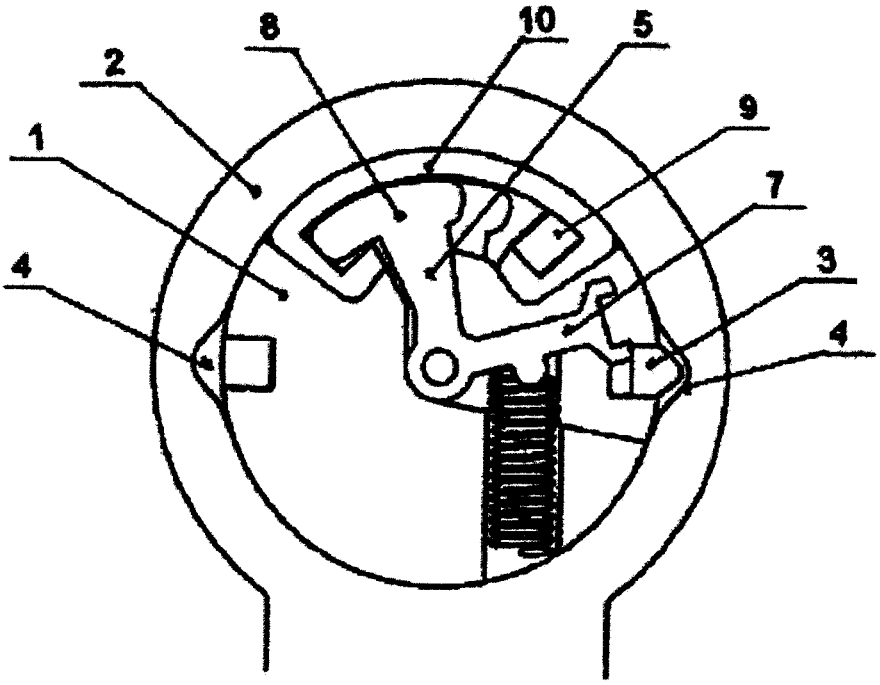
In FIG. 4 there is the cylindrical plug assembly in the lock housing, with an inserted key according to FIGS. 1 and 2, at the moment when the turning of the blocking lever in the position given by the height of the coding surface in the bottom of the U-shaped end part of the key profile does not allow for inserting the sidebar into the recess of the blocking lever and thus the turning of the plug in the housing.
Figure 5:
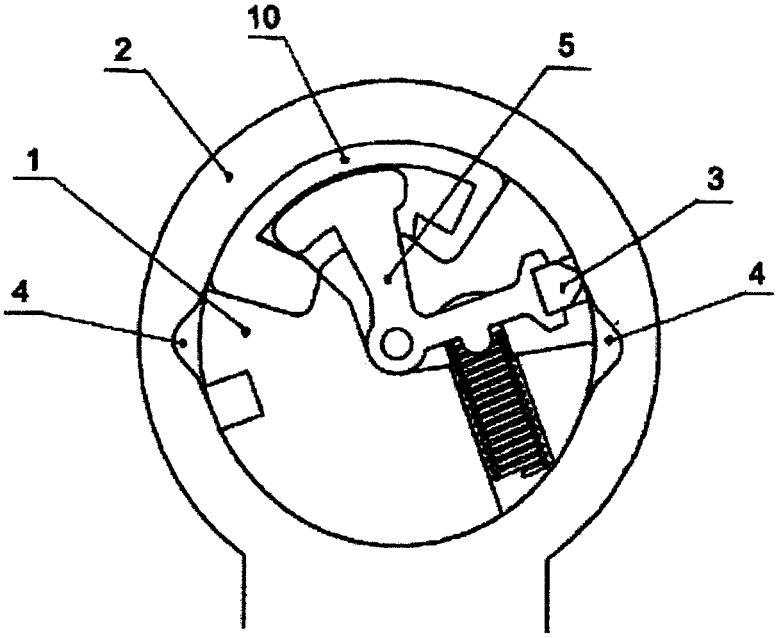
FIG. 5 shows the assembly according to FIG. 4 in the position of the blocking lever that allows for inserting the sidebar into the recess in the lever and thus the turning of the entire plug.
Figure 6:
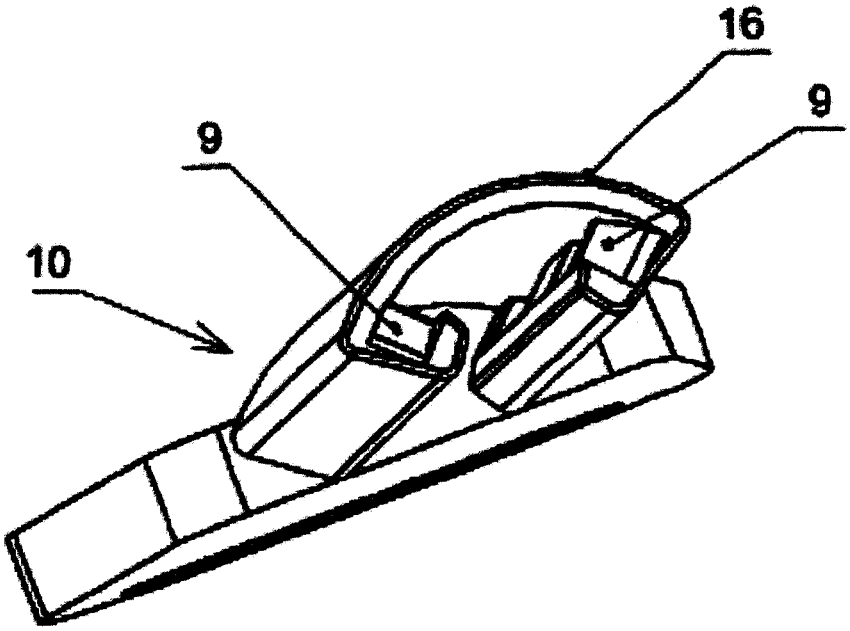
In FIGS. 6 and 7 show the key according to FIG. 1 in the design where its coding surface is created in the surface of the bottom of the U-shaped profile sides.
Figure 7:
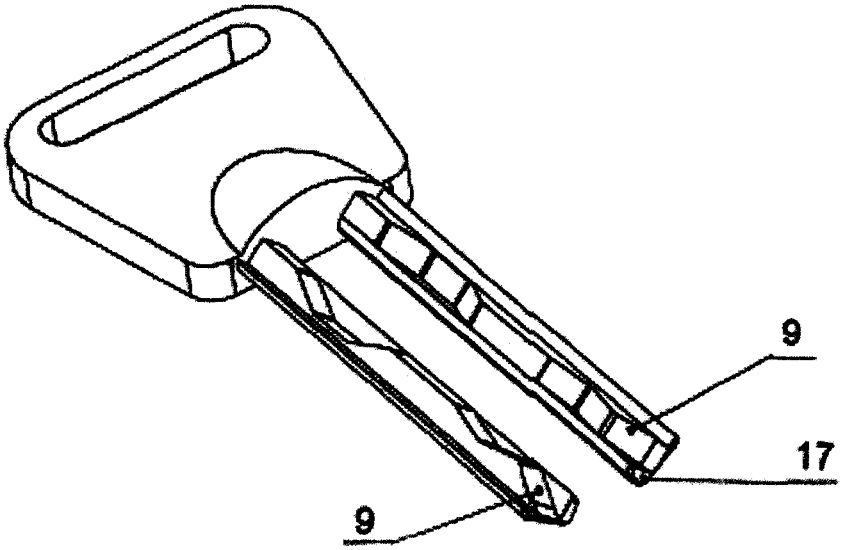
Figure 8:
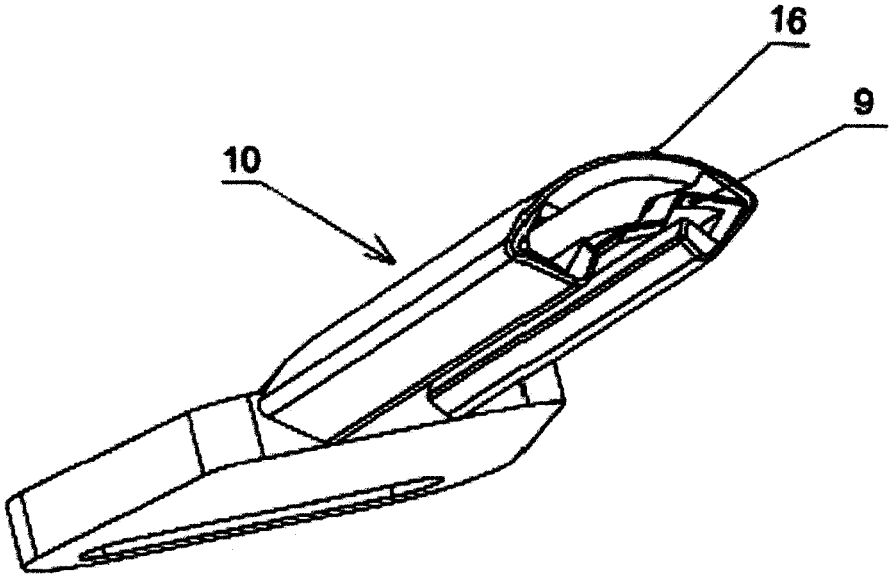
FIGS. 8 and 9 show the key according to FIG. 1 in the design where its coding surface is created in the groove in the inner arch wall of the key.
Figure 9:
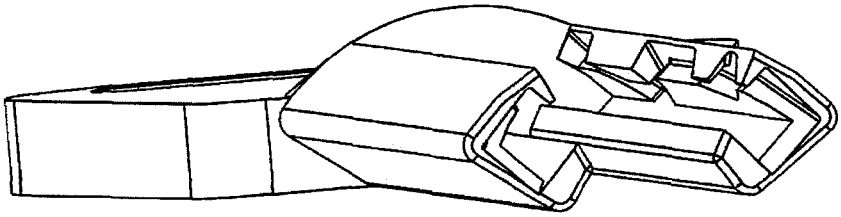
Figure 10:
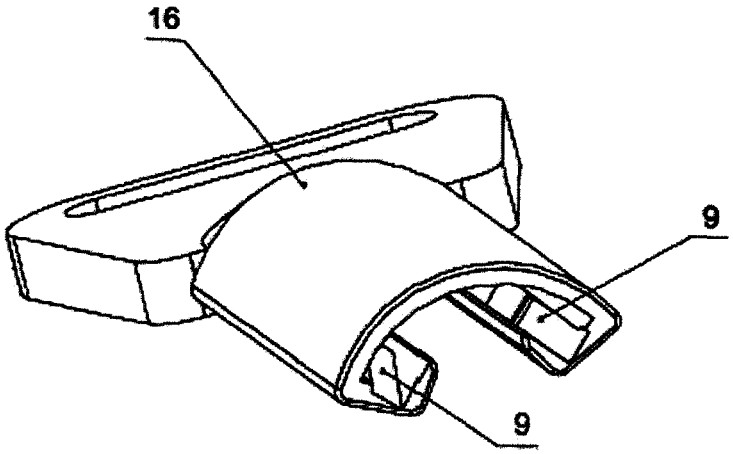
FIGS. 10 and 11 show the key according to FIG. 1 in another design where its coding surface is created in the inner wall of the U-shaped profile of the key, which is better hidden inside the key shank and reading its code is more difficult.
Figure 11:
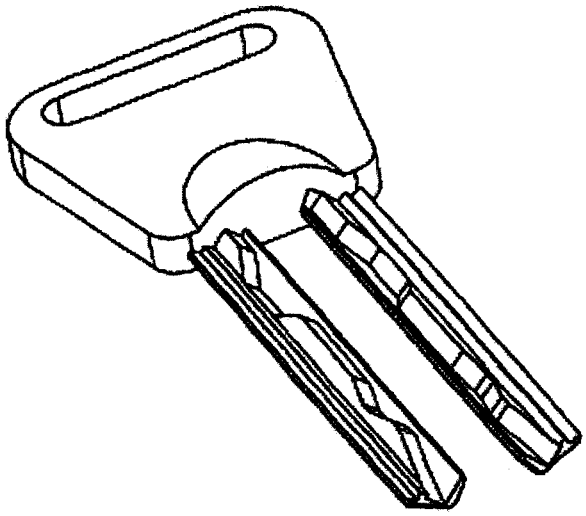
Figure 12:
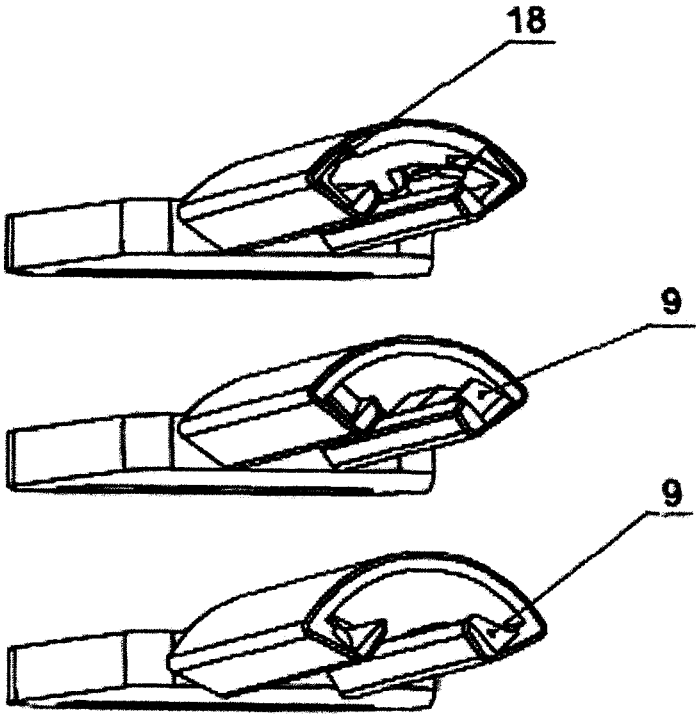
FIG. 12 shows three designs for comparing the visibility of the coding surface in the key, at the bottom is the variant with the coding surface in the bottom of the U-shaped profile, in the middle is the coding groove in the wall of the inner arch of the key, and at the top is the partial coding surface in the inner wall of the U-shaped profile.
Figure 13:
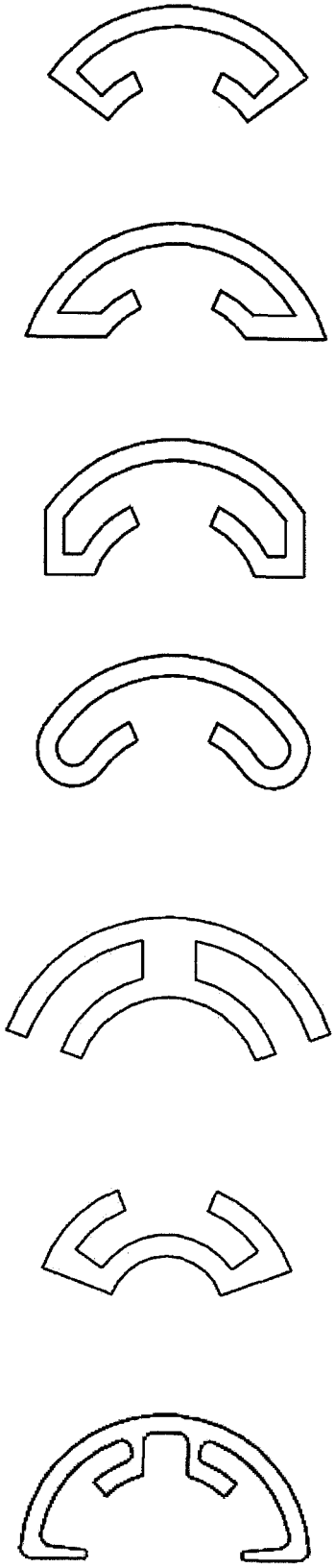
FIG. 13 shows various shape variants of the key shank profile in a section.
Figure 15:
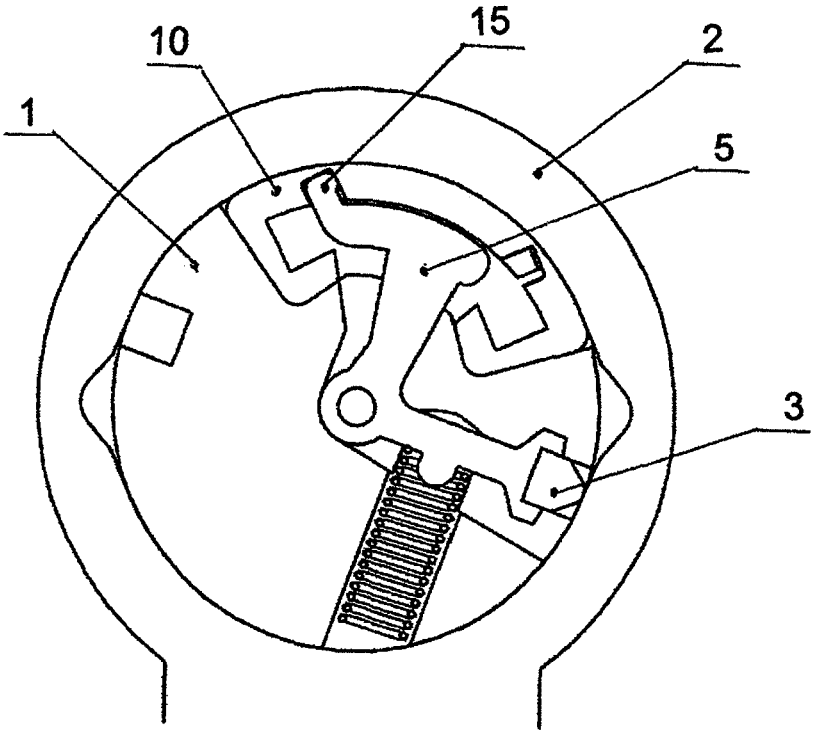
In FIG. 15, groove coding is shown, located in the inner arch of the hollow semi-enclosed key, in the position where the coding lever is turned using a bill protruding into the coding groove and where this lever is turned so that the slot in the lever matches the position of the sidebar and the plug may turn in the lock housing.

Every blocking lever 5 is formed by a two-arm lever, where, in the release functional position of the dividing surface between the plug 1 and the housing 2 of the lock, the sidebar 3 fits into the shaped end of the first arm 7 of this lever for allowing the turning of the plug 1 inside the housing 2 of the lock (FIGS. 3, 5, and 15). The shaped end of the other arm 8 of this lever is with an advantage under the thrust of the pushing spring 14 in contact with the shaped surface of the coding track 9 (or channel 18) in a part of the inner wall of the semi-enclosed hollow shank 10 of the key n (FIGS. 5 and 15). The pushing spring 14 is put on the stump 13 of the first arm 7 of the two-arm lever of the turning blocking lever 5 (FIGS. 3 and 4). In case every turning blocking lever 5 is turned correctly, pushing of the sidebar 3 into the recess in the blocking lever 5 is allowed at a depth so that the sidebar 3 does not exceed the outer perimeter of the plug 1 and thus allows for free turning of the plug 1 in the body (housing 2) of the cylindrical plug 1.

Figure 19:
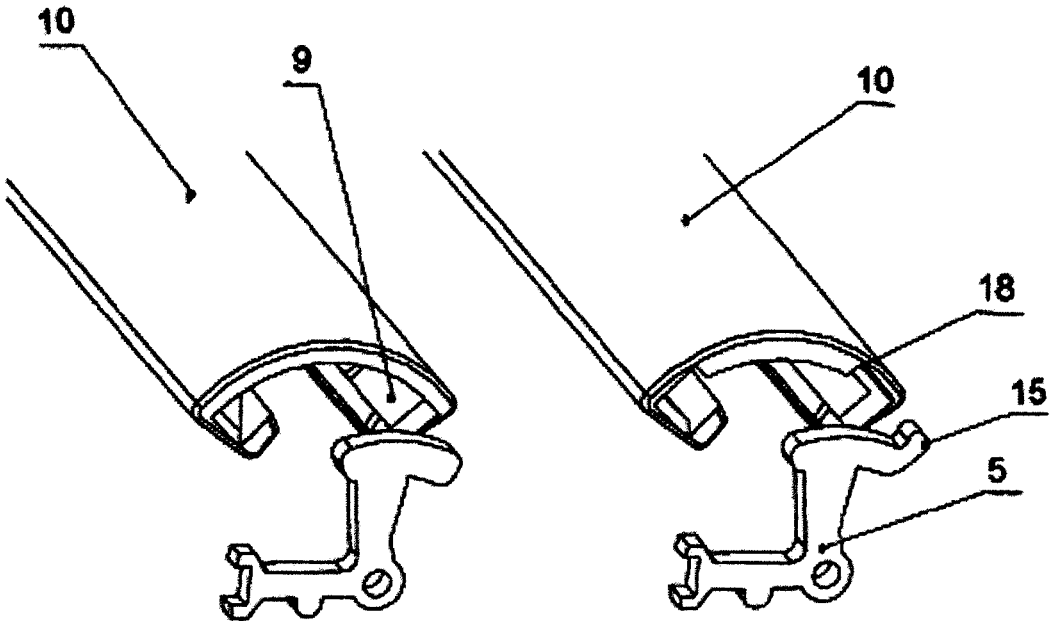
In FIG. 19 there is the comparison of two designs of the blocking levers, and in FIG. 20 there are the basic variants of the blocking lever shapes, depending on the sidebar placement.
Figure 20:
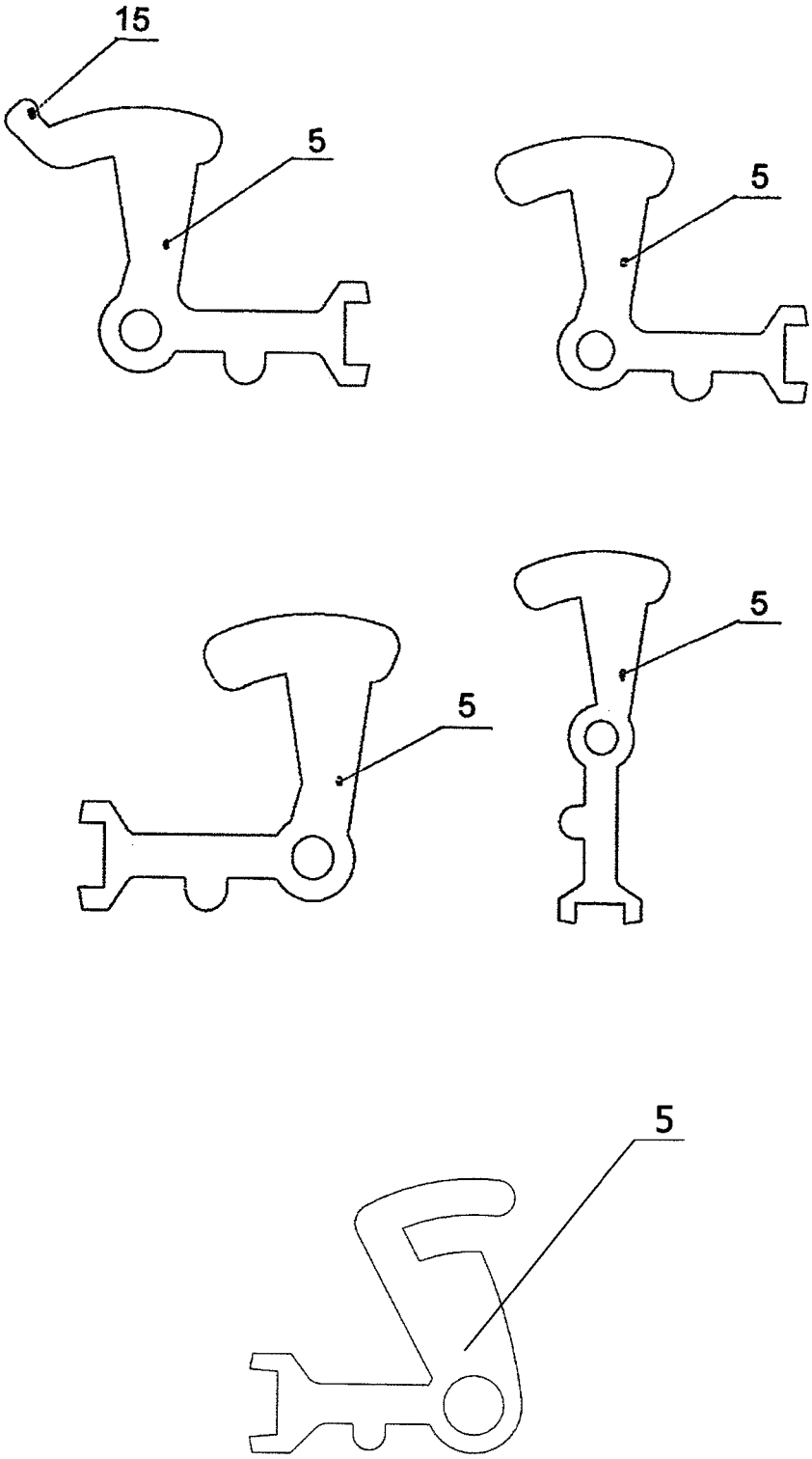

The basic shapes of the blocking levers 5 are shown in FIG. 20; they are chosen depending on the location of the sidebar 3 and the longitudinal groove 4 in the plug 1. The angular position of the longitudinal groove 4 in the housing 2 and the corresponding location of the sidebar 3 in the plug 1 is general. The shaping of the blocking levers 5 corresponds to the requirements for their functionality, strength, minimum material consumption, and manipulation prevention capabilities (so-called picking). FIG. 19 shows a comparison of two designs of blocking levers 5. On the right side of FIG. 19, the blocking lever 5 is turned by the protrusion or bill 15 protruding into the coding groove or channel 18. On the left side of FIG. 19 the blocking lever 5 is turned by the contact between the wavy coding track 9 and the edge of the lever 5.

FIG. 4 shows the assembly according to this invention at the moment when the position or turning of the blocking lever 5 (which is given by the height of the wavy surface of the coding track 9 at the given point of the shank 10 of the key 11), pushed by the pushing spring 14 to the external surface of the coding track 9, does not allow for inserting the sidebar 3 into the recess in the blocking lever 5. The sidebar 3 remains ejected from the contour of the plug 1 and protrudes into the longitudinal groove 4 in the inner surface of the housing 2. Subtle turning of the plug 1 in the housing 2 is in this case only allowed within the range of the clearance between the sidebar 3 and the longitudinal groove 4 in the inner surface of the housing 2.

The position or turning of the blocking lever 5, shown in FIG. 5 (which is given by the height of the wavy surface of the coding track 9 at the point of the key shank 11 in question), pushed by the pushing spring 14 to the external surface of the coding track 9, allows for inserting the sidebar 3 into the recess in the blocking lever 5 and thus also the turning of the entire plug 1.

The key 11 for controlling the lock according to this invention has a shank 10, the body of which is at least in a part of its length formed by a hollow semi-enclosed profile with an open cleft 19 for inserting one arm (the second arm 8) of the two-arm lever of every turning blocking lever 5. The key 11 may be made of metal, glass, ceramics, plastic, stone and/or wood (composite with wood contents). The body of the shaft 10 is symmetrical against its longitudinal axis, with an advantage. The head of the key 11 has a thickness of approximately 3 mm, its steel shank 10 has a length of 25-35 mm, width of 10-13 mm, and wall thickness approximately 0.5-2 mm.

Figure 2:
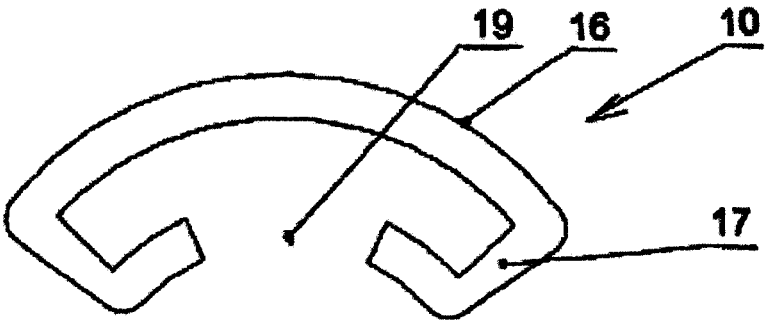
FIG. 2 shows this key according to FIG. 1 in the lateral perpendicular section.

In one of the possible designs, the shank 10 of the key n has an external rounded surface 16 (FIGS. 1 and 2), where its rounding at least in a part of this rounded surface 16 corresponds to the rounding of the inner surface of the housing 2 of the cylindrical plug 1 of the lock. Both sides of the shank 10 of the key n are U-shaped and its bottom with a width of approximately 2-2.5 mm or the inner wall of this part of the shank 10 is fitted with a shaped coding track 9 (or channel).

Figure 14:
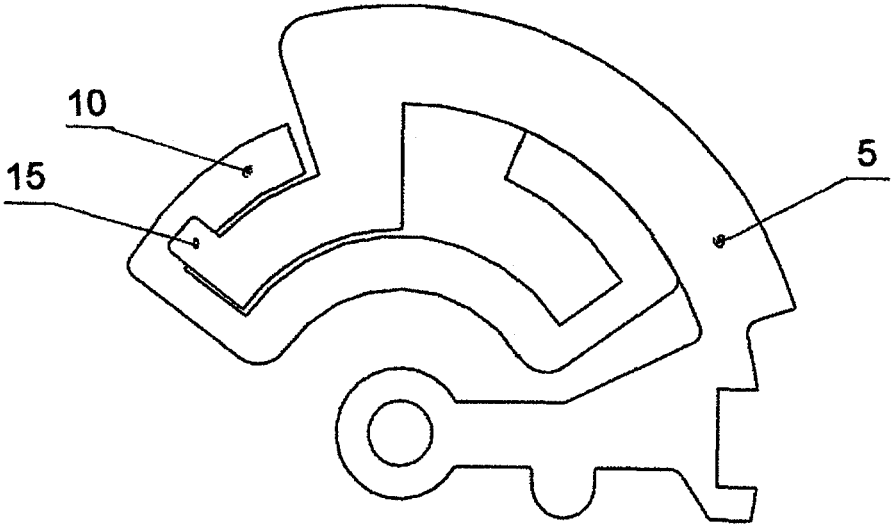
In FIG. 14 the design of the blocking lever for the profile of the key shank is shown, where the outer rounded surface of the coding lever corresponds with the rounding of the inner cylindrical surface of the cylindrical plug and the coding surface is located in the bottom of the shank profile, possibly, the coding groove is created in the shank profile wall and it is read by the coding lever bill.

In another design of the key n (FIG. 14), the external rounded surface 16 of its shank 10 is concentric with the rounding of the inner surface of the housing 2 of the cylindrical plug 1 of the lock, where the side part of the shank 10 is formed in the U-shape, while in this part the bottom or the wall of the inner or outer arch of the shank 10 is fitted with a coding channel 18 or a groove.

Figure 21A:
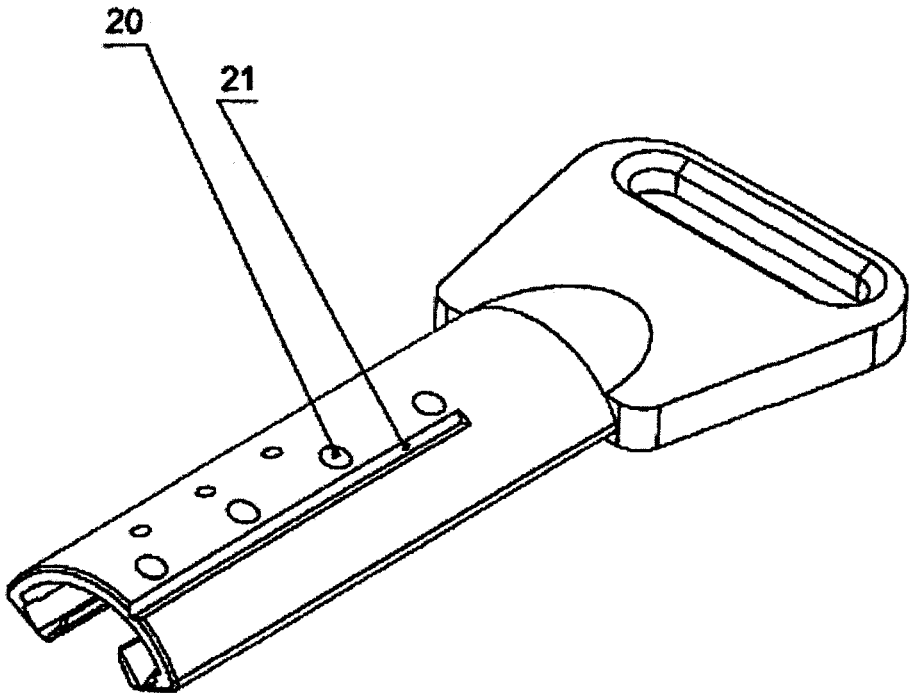
In FIG. 21A there is a key where additional coding elements in the shape of dimples or holes and/or grooves on the upper part of the shank and additional dimples on the bottom side of the key shank are shaped in the outer surface of its shank (FIG. 21B).
Figure 21B:
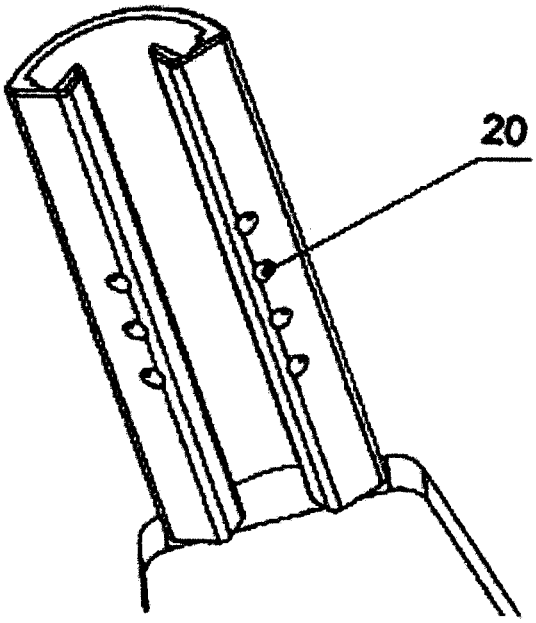
Figure 22A:
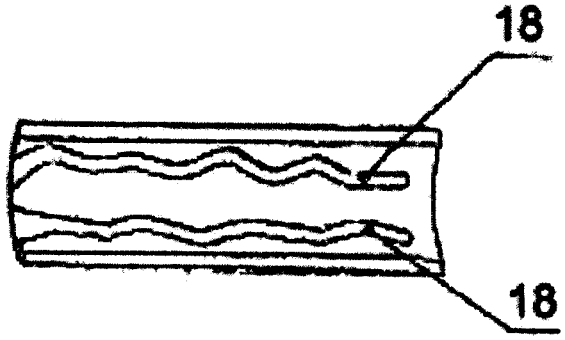
In FIG. 22 there is a view from the inside of the key, where two coding channels with mutually separate tracks (FIG. 22A), possibly intersecting tracks (FIG. 22B), are in the semi-enclosed profile.
Figure 22B:
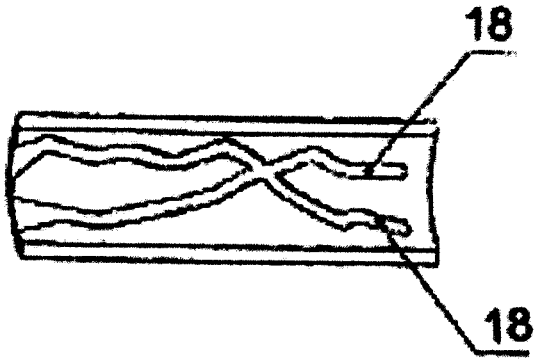

In the outer surface of the shank 10 of the key n, additional coding elements in the shape of dimples or holes 20 and/or grooves 21 may be shaped (see FIG. 21). In the semi-enclosed profile of the shank 10 of the key n, there may be at least two coding channels with separated or intersecting tracks 9 (see FIG. 22).

Figure 23:
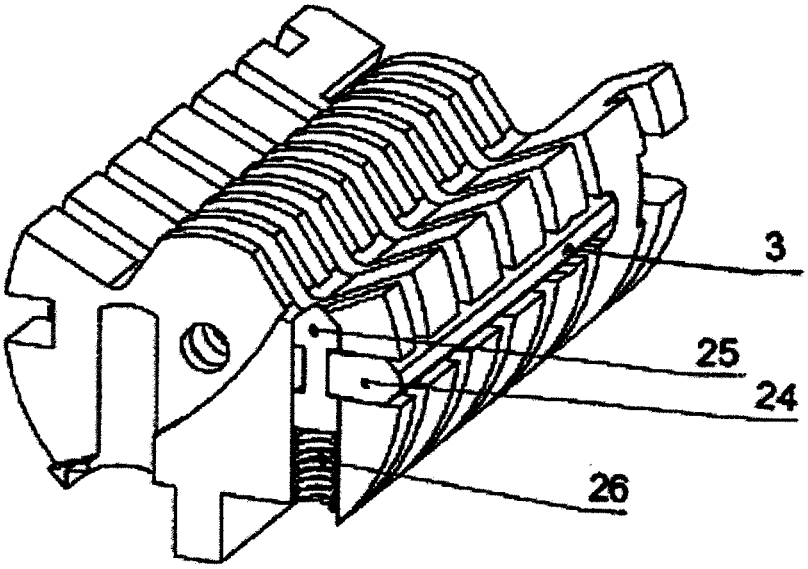
FIG. 23 shows a section of the sprung blocking pin controlled by a dimple created on the bottom side of the key shank. The blocking pin cooperates with the sidebar and in case of an incorrect code on the bottom side of the shank, it prevents the insertion of the sidebar into the longitudinal groove created in the lock plug and thus prevents the turning of the plug in the lock housing.

The sidebar 3 is furthermore adapted for cooperation with the vertically placed blocking pins 25, which are located in the vertical openings in the plug 1 and are pushed by the springs 26 into contact with the coding dimples 20 located on the external surface of the shank 10 of the key n (FIG. 23). Upon inserting a key with an incorrect code 20 on the external surface of the shank 10 of the key 11, it is impossible to move the sidebar 3 into the position in which the sidebar nose 24 is inside the contour of the lock plug 1, and in which the turning of the lock plug 1 inside the lock housing 2 is allowed.

The blocking system of the lock may also contain at least one blocking pin 25 (see FIG. 23), which is adapted for ejecting into contact with the coding dimple 20 using the spring 26 and cooperating with the sidebar 3.

The key n may also contain additional coding based on the principle of at least one electronic, magnetic, or biometric sensor or their combinations. It may also include an electronic device serving for generating energy based on the key movements during its use.

LIST OF REFERENCE NUMERALS

1 . . . plug
2 . . . housing
3 . . . sidebar
4 . . . longitudinal groove in the inner surface of the housing
5 . . . validating levers
6 . . . plug body slots
7 . . . first (blocking) arm of the two-arm lever of the validating lever
8 . . . second (coding) arm of the two-arm lever of the validating lever
9 . . . open coding track
10 . . . key shank
11 . . . key
12 . . . key shank end
13 . . . blocking lever two-arm lever arm stump
14 . . . spring
15 . . . protrusion or bill
16 . . . outer key shank round surface
17 . . . U-shaped key shank part
18 . . . coding channel
19 . . . cleft
20 . . . coding dimples (in the key shank outer round surface 16)
21 . . . coding groove (in the key shank outer round surface 16)
22 . . . coil spring
23 . . . groove in the lock plug 1 for inserting the sidebar 3
24 . . . sidebar 3 nose
25 . . . blocking pin
26 . . . blocking pin spring

The invention claimed is:

1. A key for controlling a lock with a cylindrical plug, a lock cavity, and at least one validating lever, the key comprising: a key coding, and a shank with a body, wherein at least a part of a length of the body of the shank has an external rounded surface and forms a hollow, partially enclosed profile, the external rounded surface being shaped for turning the key in the lock cavity, while at least in an end part of a lateral section of the shank, an open cavity is configured to receive an arm of the at least one validating lever of the lock, the key coding being located in the open cavity.

2. The key according to claim 1, wherein the shank includes a U-shaped or a V-shaped part defining part of the hollow, partially enclosed profile, and the U-shaped or the V-shaped part of the shank is fitted with at least one open coding track with the key coding, or at least one coding channel with a shaped coding surface with the key coding, or at least one open coding track with the key coding and at least one coding channel with a shaped coding surface with the key coding.

3. The key according to claim 2, wherein the shape and/or the dimension and/or the position of the open shaped coding track and/or the coding channel varies along a longitudinal axis of the shank.

4. The key according to claim 1, wherein, in the partially enclosed profile of its shank, there are at least two coding channels, which have mutually separate or intersecting tracks.

5. The key according to claim 1, wherein, on the outer surface of its shank, additional coding elements in the shape of dimples or holes and/or grooves are created.

6. The key according to claim 1, wherein the shank comprises an inner wall portion, an outer wall portion and a bottom wall portion arranged therebetween for forming a part, which is substantially U-shaped or V-shaped, at least one of the inner wall portion, the outer wall portion and the bottom wall portion including a shaped coding surface.

7. The key according to claim 6, wherein the shaped coding surface is part of at least one coding track or of at least one coding channel or of both.

8. The key according to claim 6, wherein at least one of a shape, a dimension and a position of said at least one coding track or said at least one coding channel or of both varies along a longitudinal axis of the shank defining the direction in which the key is insertable into the lock.

9. The key according to claim 1, further comprising an additional coding configured to be validated by at least one of an electronic, magnetic, and biometric sensor.

10. A lock configured for validating a key according to claim 1, wherein the lock includes at least one cylindrical plug with a cavity for inserting a hollow, partially enclosed profile of the shank of the key rotatably mounted in a lock housing, wherein the plug is in its outer longitudinal groove provided with a sidebar which engages the inner surface of the housing, wherein the sidebar is adapted for insertion into turning validating levers, which are arranged in a row in the longitudinal axis of the plug on the pivot in the plug and are located in lateral slots along the length of the plug, where turning validating levers are in case of incorrect coding of the key in the blocked functional state in a position preventing the insertion of the sidebar into the groove in the plug, and thus the turning of the plug inside the housing of the lock, while in the unblocked state in case of correct coding of the key they are in the functional position allowing for the movement of the sidebar in the direction into the groove in the plug and thus the turning of the plug inside the housing of the lock, while the validating levers at least partially protrude into the open cavity of the key, by which they allow for reaching contact between the validating levers and a coding track or a coding channel of the key.

11. The lock according to claim 10, wherein every validating lever is formed by a two-arm lever, where a shaped, blocking end of one arm of each two-arm lever is adapted for cooperation with the sidebar while a shaped end of the other arm of each two-arm lever is shaped for contact with the coding track or the coding channel of the key.

12. The lock according to claim 11, wherein the one arm is fitted with a protrusion for putting on the pushing spring situated inside the plug, and the end of the other arm is shaped into a protrusion or a projection for contact with an open coding track or a coding channel in the hollow, partially enclosed profile of the shank of the key.

13. The lock according to claim 11, wherein the sidebar is in an unblocked state arranged in a movable manner between a bottom of a groove defined in an inner surface of the housing of the lock, and a slot in the blocking arm of the validating lever.

14. The lock according to claim 11, further comprising at least one blocking pin, biased with a spring into contact with a coding dimple of the key and cooperating with the sidebar, while the blocking pin is in case of incorrect coding of the key in the blocked functional state in a position preventing the complete insertion of the sidebar into the groove in the plug, and thus the turning of the plug inside the housing of the lock, while in the unblocked state in case of correct coding of the key, it is in the functional position allowing for the moving of the sidebar into a position where the front part or nose of the sidebar is inside the contour of the plug of the lock and thus the turning of the plug inside the housing of the lock.

15. A lock for validating a key according to claim 1, comprising at least one cylindrical plug with a lock cavity configured to receive a hollow, partially enclosed profile of a shank of the key, a housing, in which the plug is mounted such that it is rotatable when a key with a correct coding is received in the lock cavity, and validating levers, which are rotatable, wherein the plug includes an outer longitudinal groove provided with a biased sidebar which engages an inner surface of the housing, wherein the validating levers are arranged in a row in a longitudinal axis of the plug on a pivot in the plug and are located in lateral slots along the length of the plug, wherein the validating levers are in case of incorrect coding of the key in the blocked functional state in a position preventing the insertion of the sidebar into the outer longitudinal groove in the plug, and thus the turning of the plug inside the housing of the lock, while in the unblocked state in case of correct coding of the key they are in the functional position allowing for the movement of the sidebar in the direction into the outer longitudinal groove in the plug and thus the turning of the plug inside the housing of the lock, while the validating levers at least partially protrude into an open cavity of the key when inserted to allow contact between the validating levers and code carriers in the key defined by a shaped coding surface.

16. The lock according to claim 15, wherein every validating lever is formed by a two-arm lever comprising a shaped, blocking end adapted for cooperation with the sidebar and another end shaped for contact with code carriers in the key defined by the shaped coding surface.

17. The lock according to claim 16, wherein an arm comprising the blocking end is fitted with a protrusion for putting on a pushing spring situated inside the plug, and said another end includes a protruding portion for contact with a coding track or a coding channel formed in a part of a shank of the key.

18. The lock according to claim 16, wherein the inner surface of the housing includes another groove, and each validating lever includes a slot, in an unblocked state the sidebar being arranged in a movable manner between the bottom of said another groove and the slots of the validating levers.

19. The lock according to claim 16, further comprising at least one blocking pin, adapted for ejecting into contact with a coding dimple of the key and cooperating with the sidebar, while the blocking pin is in case of incorrect coding of the key in the blocked functional state in a position preventing a complete insertion of the sidebar into the outer longitudinal groove in the plug, and thus the turning of the plug inside the housing of the lock, while in the unblocked state in case of correct coding of the key, it is in a functional position allowing the sidebar to be moved into a position where a front part of the sidebar is inside a contour of the plug of the lock and thus enabling a turning of the plug inside the housing of the lock.

* * * * *